US007581500B2

(12) United States Patent
Flatau

(10) Patent No.: US 7,581,500 B2
(45) Date of Patent: Sep. 1, 2009

(54) PAYLOAD DELIVERING RING AIRFOIL PROJECTILE

(75) Inventor: Abraham Flatau, Palo Alto, CA (US)

(73) Assignee: Flatau & Vanek, LLC, Bel Air, MD (US)

( * ) Notice: Subject to any disclaimer, the term of this patent is extended or adjusted under 35 U.S.C. 154(b) by 0 days.

(21) Appl. No.: 10/769,399

(22) Filed: Jan. 30, 2004

(65) Prior Publication Data

US 2005/0183615 A1 Aug. 25, 2005

(51) Int. Cl.
*F42B 10/36* (2006.01)

(52) U.S. Cl. ..... 102/503; 102/502

(58) Field of Classification Search ..... 102/501, 102/502, 503, 509
See application file for complete search history.

(56) References Cited

U.S. PATENT DOCUMENTS

| | | | | | |
|---|---|---|---|---|---|
| 3,815,271 | A | * | 6/1974 | Lynn | 42/84 |
| 3,877,383 | A | | 4/1975 | Flatau | |
| 3,898,932 | A | | 8/1975 | Flatau et al. | |
| 3,912,197 | A | * | 10/1975 | McKown et al. | 244/3.13 |
| 3,951,070 | A | | 4/1976 | Flatau et al. | |
| 3,956,844 | A | * | 5/1976 | Misevich et al. | 42/90 |
| 3,980,023 | A | * | 9/1976 | Misevich | 102/502 |
| 3,982,489 | A | | 9/1976 | Flatau et al. | |
| 4,154,012 | A | * | 5/1979 | Miller | 42/105 |
| 4,177,733 | A | * | 12/1979 | Romer et al. | 102/503 |
| 4,190,476 | A | | 2/1980 | Flatau et al. | |
| 4,212,244 | A | | 7/1980 | Flatau | |
| 4,262,597 | A | * | 4/1981 | Olson | 102/502 |
| 4,378,740 | A | * | 4/1983 | Schneider, Jr. | 102/216 |
| 4,456,265 | A | * | 6/1984 | Adler | 473/589 |
| 4,827,847 | A | * | 5/1989 | Laviolette et al. | 102/503 |
| 4,882,997 | A | * | 11/1989 | Baxter et al. | 102/503 |
| 5,067,406 | A | * | 11/1991 | Olson et al. | 102/374 |
| 5,515,787 | A | * | 5/1996 | Middleton | 102/503 |
| 5,544,586 | A | * | 8/1996 | Huerta | 102/374 |
| 6,647,890 | B2 | * | 11/2003 | Findlay | 102/503 |
| 2005/0066843 | A1 | * | 3/2005 | Flatau et al. | 102/503 |

FOREIGN PATENT DOCUMENTS

| | | | |
|---|---|---|---|
| DE | 3245906 | * | 6/1984 |
| FR | 2609332 | * | 7/1988 |

* cited by examiner

*Primary Examiner*—David J Parsley
(74) *Attorney, Agent, or Firm*—Weide & Miller, Ltd.

(57) ABSTRACT

A ring airfoil projectile is defined by an annular body which defines a central passage. The body is constructed so that a center of pressure is substantially coincident with a center of gravity thereof. The body is preferably constructed of a nose section and tail section, the nose section of a material having a higher density than the material forming the tail section. The ring airfoil projectile is configured to deliver a payload to a target. Cavities extend inwardly from the outer surface of the airfoil, preferably in the nose section. The cavities accept payload or a strip containing payload. The ring airfoil projectile is configured to travel with minimum path dispersion, and to deliver the payload upon impacting a target.

4 Claims, 3 Drawing Sheets

PAYLOAD DELIVERING RING AIRFOIL PROJECTILE

FIELD OF THE INVENTION

The present invention relates to ring airfoil projectiles, and more particularly to an improved ring airfoil which is configured to deliver a payload.

BACKGROUND OF THE INVENTION

A need exists for a safe and effective means of delivering materials, such as suppression agents, to a remote individual. For example, it is desirable to provide a safe and effective means of delivering a suppression agent from a law enforcement officer to a criminal or terrorist, such as in the case of a mob or riot, when apprehending such individuals when fleeing, and where such individuals are engaged in a crime.

Of course, a variety of weapons are known which are designed to invoke lethal results. Non-lethal weapons are also known, such as tear gas grenade launchers and stun guns. In the case of stun guns, the user must be generally located within reach of the target. This increases the risk to the user and also prevents use of the gun in many instances. Tear gas grenades are not designed to deliver agent to a particular individual, but to an area. In addition, the grenades and grenade launchers are not extremely accurate over long distances. Over long distances, the grenades must be launched so that they travel a parabolic flight path.

Ring airfoils are known for their ability to travel long distances along a very flat and straight trajectory. For example, U.S. Pat. No. 3,982,489 to the inventor herein details a ring airfoil projectile which is useful as a non-lethal projectile. In this case, however, the energy imparted to the target (e.g. criminal) is the "payload" which is delivered by the ring airfoil. Some attempts have been made at creating a ring airfoil which is capable of delivering an agent. For example, U.S. Pat. Nos. 3,898,932 and 3,951,070 both detail ring airfoils having a hollow interior space containing a control agent. The projectile is configured to rupture at impact and deliver the control agent.

Unfortunately, several problems arise when considering a ring airfoil configured for payload delivery. Foremost is that introduction of the payload into the ring airfoil moves the center of gravity CG thereof. This affects the flight characteristics of the ring airfoil, generally increasing the dispersion of the ring airfoil from a straight trajectory. This is, obviously, undesirable because it decreases the likelihood that the payload will reach the intended target.

An improved payload delivering ring airfoil projectile is desired.

SUMMARY OF THE INVENTION

The present invention is a ring airfoil projectile. The ring airfoil projectile is preferably configured to deliver a payload to a target. The ring airfoil projectile is designed with improved flight characteristics.

In one embodiment, the ring airfoil projectile comprises a generally annular body which defines a central passage. The body is constructed so that a center of pressure is coincident or substantially coincident with a center of gravity thereof. In this manner, the ring airfoil projectile has no static stability or, stated another way, has neutral stability.

The body is preferably constructed of a nose section and tail section, the nose section comprising a material having a higher density than the material forming the tail section. In one embodiment, the nose section is constructed of rubber and the tail section is constructed of foam.

The nose and tail sections may be selectively connected and disconnected. In one embodiment, the nose section has a groove in a rear face thereof for accepting an outwardly extending key in a front face of the tail section.

The ring airfoil projectile is configured to deliver a payload to a target. In one embodiment, a plurality of cavities extend inwardly from the outer surface of the airfoil, preferably in the nose section. The cavities are spaced apart around the ring airfoil, each cavity separated from the next cavity by a dividing wall.

The cavities accept payload or a strip containing payload. In one embodiment, the payload is located in the cavities and then enclosed with a covering. In another embodiment, the payload is associated with a payload strip which is connected to the ring airfoil projectile. The ring airfoil projectile is preferably configured to deform upon impacting a target, thereby delivering or releasing the payload at the target.

In a preferred embodiment, the ring airfoil projectile is launched with spin. Preferably, the rotational velocity of the ring airfoil projectile when launched is not greater than about 0.2 of the forward velocity of the projectile. This rotational velocity imparts gyroscopic stability to the projectile during flight.

In one embodiment, the ring airfoil projectile is mounted to a sabot. The sabot engages rifling in a barrel of a launcher, thus imparting rotation to the sabot and the ring airfoil projectile. After the forward and rotational velocity is imparted to the sabot and ring airfoil projectile during launch, the sabot is stripped from the ring airfoil projectile, which then travels towards the intended target.

The configuration of the ring airfoil projectile allows the ring airfoil to carry a payload and at the same time travel with minimum path dispersion. When the ring airfoil projectile impacts the desired target, the payload is delivered to the target.

Further objects, features, and advantages of the present invention over the prior art will become apparent from the detailed description of the drawings which follows, when considered with the attached figures.

DETAILED DESCRIPTION OF THE INVENTION

The invention is a ring airfoil projectile. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a ring airfoil projectile. The ring airfoil projectile is preferably constructed to deliver a payload such as a suppression agent. Further, the ring airfoil projectile is configured with improved flight characteristics, with a center of gravity CG and center of pressure CP thereof are substantially coincident. In a preferred embodiment, the ring airfoil projectile is of a two-piece construction, a fore or nose section of the ring airfoil constructed from a material having a substantially higher density than a material used to construct a tail or aft section of the ring airfoil.

Figure 2:
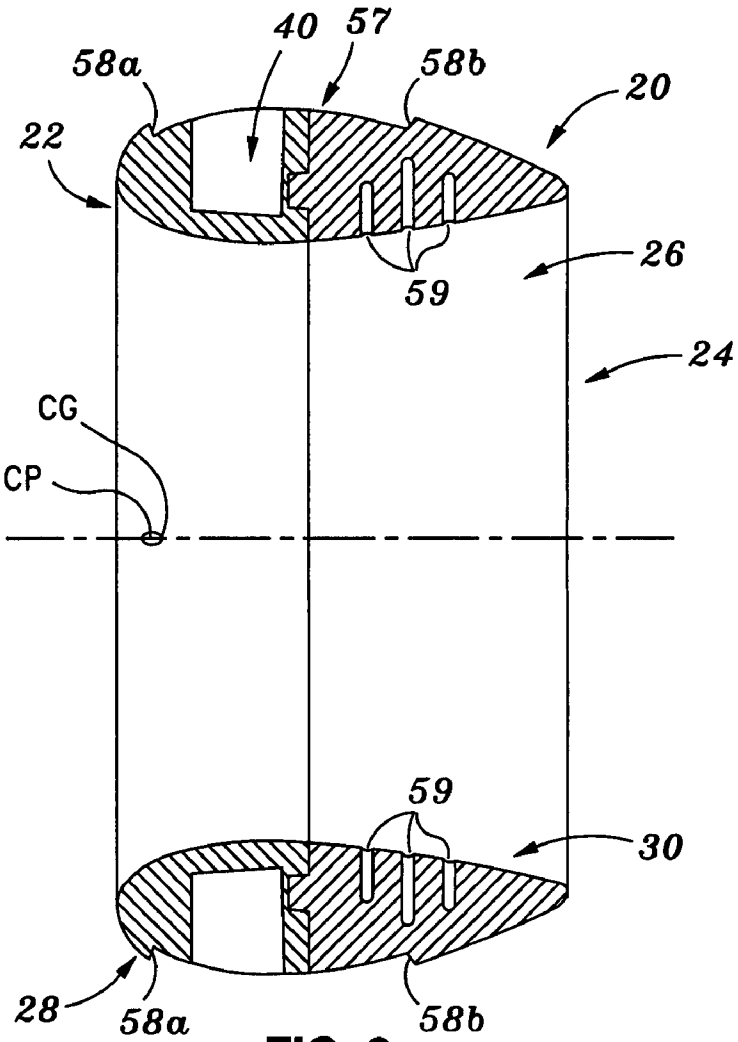
FIG. 2 is a cross-sectional side view of the ring airfoil projectile illustrated in FIG. 1 taken along line 2-2 therein.
Figure 1:
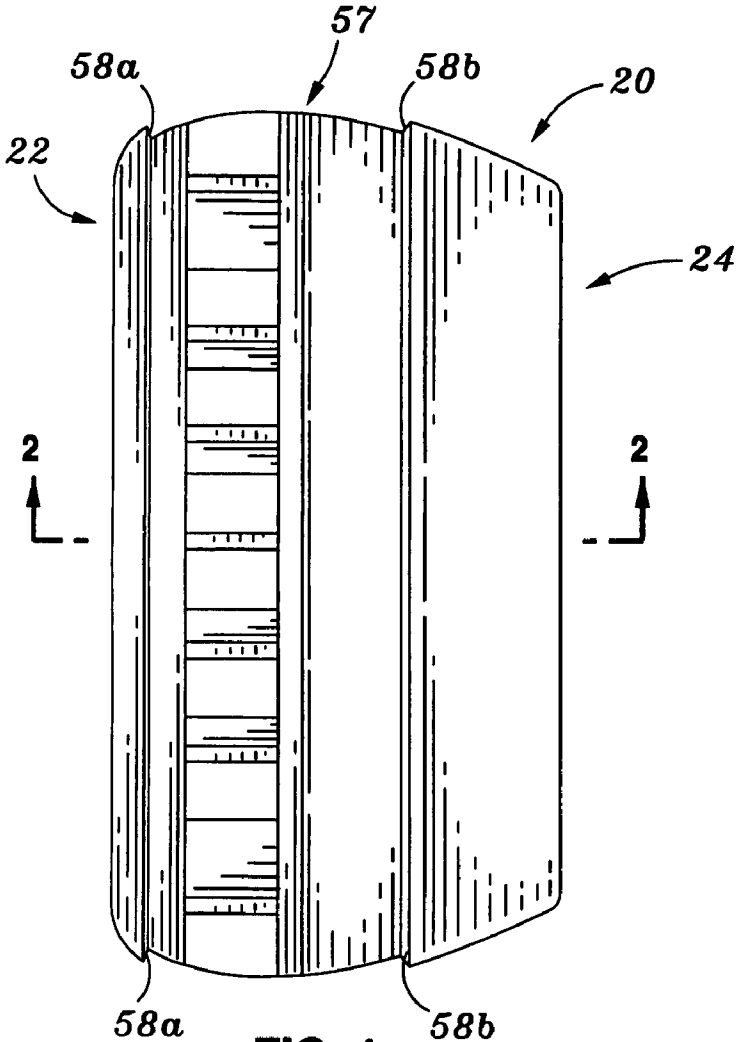
FIG. 1 is a side view of a ring airfoil projectile in accordance with an embodiment of the invention.

A preferred embodiment of the invention will be described with reference to FIGS. 1-4. FIG. 1 illustrates a ring airfoil projectile (RAP) 20. The ring airfoil projectile 20 has a front or nose 22 and a rear or tail 24. Referring to FIG. 2, the ring airfoil projectile 20 defines a central passage 26 through which air flows in the direction of the front 22 to the rear 24 when the ring airfoil projectile 20 is traveling.

The ring airfoil projectile 20 is defined by a body. As is known in the art, the body comprises a generally annular or ring-shaped element. In a preferred embodiment, the body comprises a forward, nose or front section 28 and a rear, tail or aft section 30.

Figure 3:
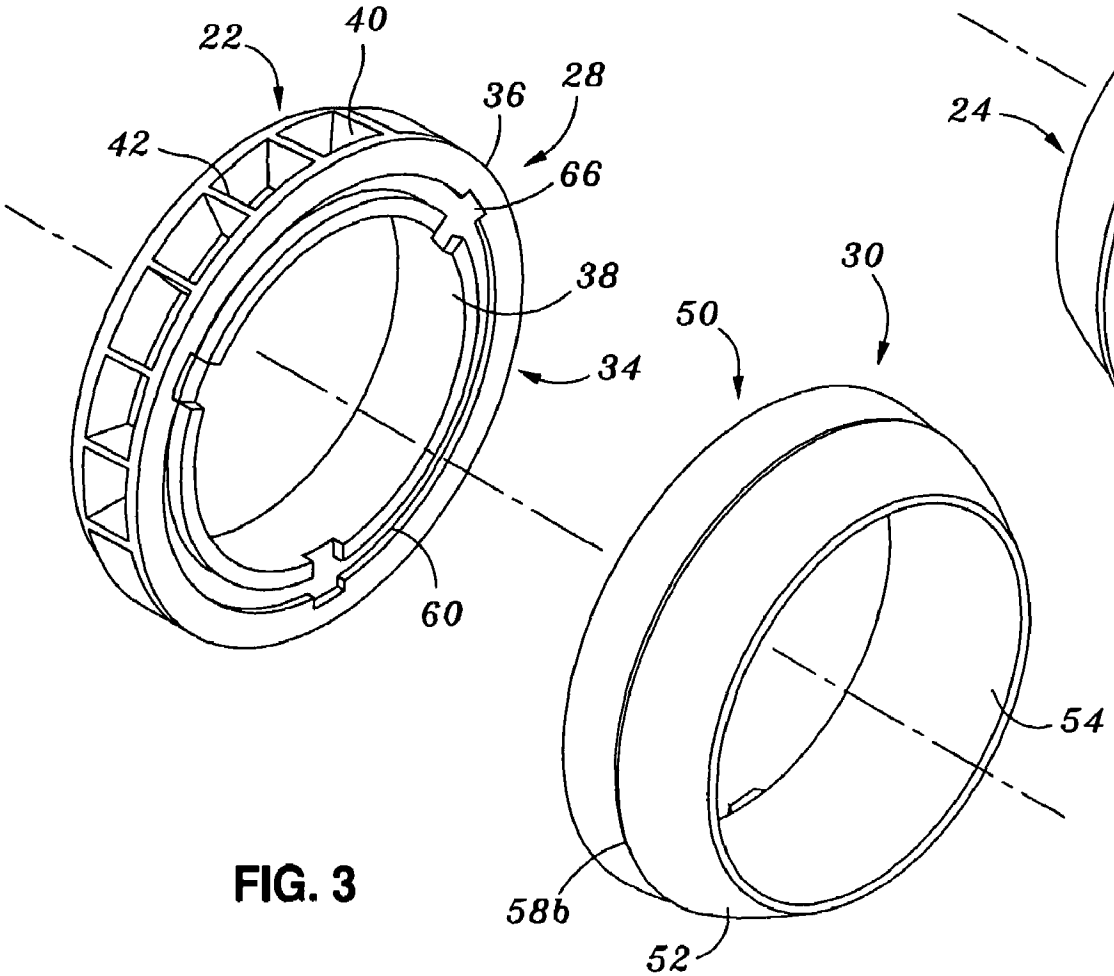
FIG. 3 is an exploded perspective view of the ring airfoil projectile illustrated in FIG. 1 showing a nose and tail section thereof separated from one another.

In a preferred embodiment, the nose section 28 of the ring airfoil projectile 20 is configured to deliver a payload. Referring to FIG. 3, the nose section 28 of the ring airfoil projectile 20 defines the nose 22 of the ring airfoil projectile 20 and has an opposing rear face 34. The nose section 28 has an outer surface 36 and an inner surface 38. As illustrated, the nose section 28 is generally circular in shape and hollow, with the inner surface 38 defining a portion of the central passage 26 through the ring airfoil projectile 20.

In one embodiment, a plurality of depressions or cavities 40 are formed in and extend inwardly from the outer surface 36 of the nose section 28 between the nose 22 and rear face 34. In one embodiment, each cavity 40 comprises a somewhat cube-shaped area in the nose section 28. As illustrated, the cavities 40 are located in annular fashion around the nose section 28, the cavities 40 separated from one another by dividing walls 42. The number of cavities 40 may vary. There may be as few as one cavity, and that cavity may extend as a slot or trough entirely around the nose section 28. There may also be a plurality of cavities 40, as illustrated.

As described in more detail below, the depressions or cavities 40 in the nose section 28 are preferably configured to hold a payload of material to be delivered by the ring airfoil projectile 20. For this reason, the cavities 40 are preferably arranged symmetrically about the nose section 28 so that when filled with payload, the mass of the payload does not affect the flight characteristics of the airfoil, including the spin thereof.

Figure 4:
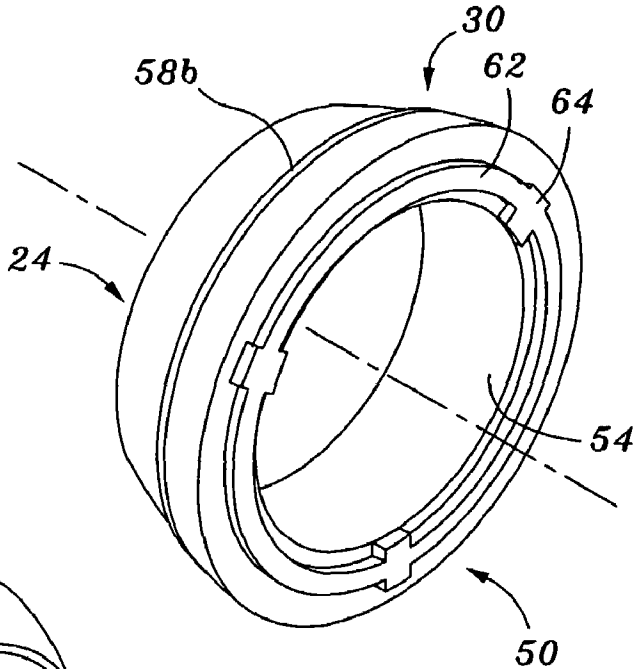
FIG. 4 is a perspective view of the tail section of the ring airfoil projectile seen from the opposing side than as shown in FIG. 3.

FIGS. 3 and 4 illustrate a tail section 30 of the ring airfoil projectile 20. As illustrated, the tail section 30 has a front face 50 and defines the rear edge 24 of the ring airfoil projectile 20. The tail section 30 has an outer surface 52 and an inner surface 54. The tail section 30 is again generally circular in shape, with the inner surface 54 thereof defining a portion of the central passage 26 through the ring airfoil projectile 20.

Referring primarily to FIG. 2, the nose section 28 and tail section 30 of the ring airfoil projectile 20 preferably contribute to an overall ring airfoil "wing" shape. In particular, the nose section 28 defines a generally rounded nose 22 leading to an area of increased body thickness towards the rear face 34 thereof. The tail section 30 has an area of increased thickness at the front face 50, and tapers towards the tail 24 of the ring airfoil projectile 20. Preferably, the thickness of the tail section 30 at its front face 54 and the thickness of the nose section 28 at its rear face 34 are the same, so that the two sections define a generally smooth inner and outer surface of the ring airfoil projectile 20, at their interface, as illustrated in FIG. 2.

The nose section 28 and tail section 30 as illustrated are configured to meet at a plane which is substantially perpendicular to a centerline through the ring airfoil projectile 20. The nose section 28 and tail section 30 may have other configurations. For example, the rear face 34 of the nose section 28 and the front face 50 of the tail section 30 may be slanted, meeting along a plane which extends at an angle between 0 and 90 degrees from a horizontal plane containing the centerline. Of course, the particular aerodynamic shape of the ring airfoil projectile 20 may vary depending upon desired characteristics.

Means are provided for selectively connecting the nose section 28 and tail section 30 of the ring airfoil projectile 20. In one embodiment, this means is a mechanical interlocking mechanism. Referring to FIG. 3, the rear face 34 of the nose section of the ring airfoil projectile 20 includes a slot or groove 60. In one embodiment, the slot 60 has a generally square or rectangular cross-sectional shape, and extends completely around the rear face 34.

The front face 50 of the tail section 30 includes a corresponding raised key 62. This key 62 is located and shaped to mate with the slot 60 in the rear face 34 of the nose section 28 when the nose section 28 and tail section 30 are connected to one another.

In one embodiment, the key 62 engages the slot 60 in a mechanical locking arrangement, this interlocking maintaining the nose section 28 connected to the tail section 30. The key 62 may include one or more tabs 64 for engaging one or more insets 66 for aligning the nose section 28 with the tail section 30 in a particular position or orientation. Alternatively, the tabs 62 and insets 66 may be configured to permit a mechanical interlock where the tabs 62 are rotated into a locking position with the insets 66.

In one embodiment, the nose section 28 and tail section 30 may be additionally secured to one another with additional or by other means, such as a chemical bond. For example, adhesive may be utilized to bond the key 62 into the slot 60. Other mechanical locking configurations are also contemplated. For example, the slot and key may be shaped in other fashions. Pins may extend outwardly from the tail section 30 for engagement with mating apertures in the nose section 28. The tail section 30 could also be heat bonded to the nose section 28.

Importantly, in accordance with the present invention, the ring airfoil projectile 20 is constructed so that its center of gravity CG coincides or is located proximate to, its center of pressure CP. In one embodiment, this is accomplished by controlling the mass of the nose section 28 and tail section 30. In a preferred embodiment, this is accomplished by the selection of materials used to form those sections, the materials having different densities. With the center of gravity CG substantially coincident with the center of pressure CP, the ring airfoil projectile 20 has static stability, or stability which is "neutral." Preferably, the projectile 20 is configured so that the center of gravity CG and center of pressure CP are substantially coincident when considering a payload which the ring airfoil projectile 20 is to carry.

In a preferred embodiment, the nose section 28 is constructed of a material having a higher density than that of the tail section 30. Preferably, the materials which are used are also selected to meet additional criteria. In particular, because the ring airfoil projectile 20 is configured to deliver a chemical payload, it is desired that the ring airfoil projectile 20 not contain any metal. Second, because the ring airfoil projectile 20 is preferably configured to impact a human target in a manner minimizing injury, it is desired that the ring airfoil projectile 20 not be constructed of a material which is unyielding and would thus concentrate the impact force and/or pierce the target. In a preferred embodiment, the nose section 28 is thus constructed of a rubber material. More preferably, the rubber material has a durometer value of around 30. In a preferred embodiment, the tail section 30 comprises inert, low density foam, such as polyethylene or polystyrene. The use of rubber for the nose section 28 has the advantage that the nose section 28 will deform so that the impact surface area of the airfoil 20 enlarges when the nose section 28 impacts a target. This spreads the impact force over a larger area, reducing harm or injury. The use of foam material for the tail section 30 has the advantage that the material is lightweight and useful in moving the center of gravity CG of the ring airfoil projectile 20 forward.

The center of pressure CP of the ring airfoil projectile 20 depends on the shape or aerodynamic profile of the ring airfoil projectile 20. Thus, the densities (and thus total mass) of the nose section 28 and tail section 30 may need to be adjusted so that the center of gravity CG coincides with the center of pressure CP when the shape of the ring airfoil projectile 20 differs. For example, if the center of pressure CP is farther forward, it may be necessary to substantially lighten the mass of the tail section 30 to correspondingly move the center of gravity CG forward. In one embodiment, this may be done by forming the tail section 30 with "lightening" holes 59 (as illustrated in FIG. 2). These holes comprise voids in the tail section 30, reducing its mass.

Figure 5:
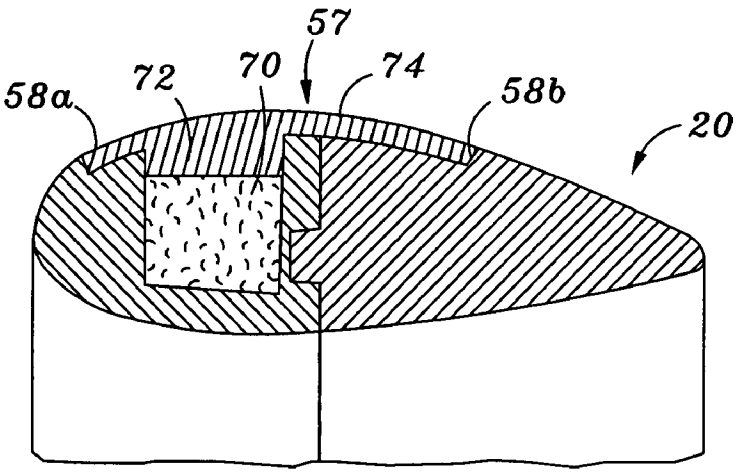
FIG. 5 is a partial cross-sectional side view of a ring airfoil projectile containing a payload in accordance with the invention.
Figure 7:
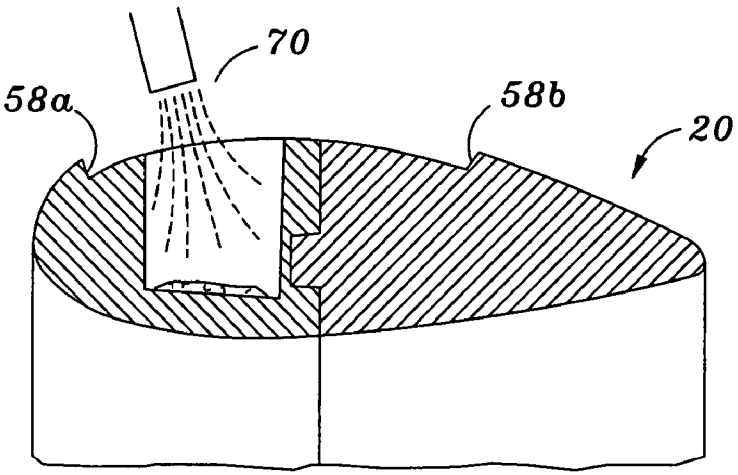
FIG. 7 is a partial cross-sectional side view of a ring airfoil as illustrated in FIG. 5 being filled with agent.

As indicated above, the ring airfoil projectile 20 is preferably configured to deliver a payload of material to an intended target. In one embodiment, as illustrated in FIG. 7, payload material 70 may be located in the cavities 40. The payload material 70 is then preferably enclosed with a covering 74, such as illustrated in FIG. 5. The covering 74 may be a strip which extends entirely around the ring airfoil projectile 20 and covers all of the cavities, or individual coverings may be configured to cover each cavity. In either case, the covering 74 is preferably configured to tear, release or open when the ring airfoil projectile 20 impacts a target (but not during normal transport, loading, storage and handling), thus allowing the payload material 70 to escape.

In a preferred embodiment, the ring airfoil projectile 20 is configured to accommodate the covering 74, whether comprising a simple cover or as part of a payload strip 72 including payload containing elements 75, while retaining a smooth and continuous exterior aerodynamic profile. As best illustrated in FIGS. 1 and 2, the nose section 28 has a step 58*a* associated with a change in thickness or outer dimension of the nose section. Likewise, the tail section 30 has a similar step 58*b* associated with a change in thickness or outer dimension of the tail section 30. As illustrated, these steps 58*a*, 58*b* face one another, thereby defining an inset 57 in the outer surface of the ring airfoil projectile 20.

Referring to FIG. 5, this inset 57 is designed to accommodate the covering 74. Preferably, the inset 57 has a depth which is generally the same as the thickness of the covering 74, such that when the covering is mounted to the ring airfoil projectile 20, the combination thereof defines a smooth outer surface of the projectile 20. In addition, the covering 74 preferably has a width which is equal to the distance between the two steps 58*a*, 58*b*, whereby it substantially fills the inset 57.

In one embodiment, the covering 74 may be of a lightweight, low shear material such as a paper covering. In order to increase the probability of rupture of the covering 74, the covering may include one or more stress risers or areas of reduced shear and/or tensile strength, such as in the case of perforations (not shown) formed therein. Concentrated force upon these stress risers or areas of reduced strength cause the covering to rupture upon impact.

Figure 6:
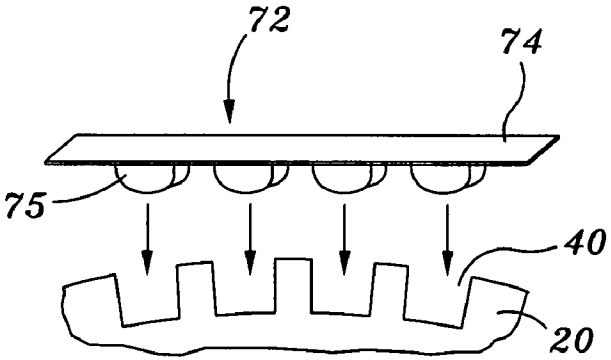
FIG. 6 is a perspective view of a payload strip for loading to a ring airfoil projectile in accordance with another embodiment of the invention.

As illustrated in FIG. 6, the payload 70 may instead be associated with a payload strip 72. The payload strip 72 preferably comprises a cover or supporting strip 74, and a number of payload containing areas 75 corresponding to the cavities 40 in the ring airfoil projectile 20 into which they are inserted. In this configuration, the payload strip 72 may be pre-manufactured and then conveniently associated with any of a variety of ring airfoil projectiles in accordance with the invention. In one embodiment, the payload strip 72 is preferably again configured to rupture when the ring airfoil projectile impacts its target. In addition, the payload strip 72 may be secured to the ring airfoil projectile 20, such as with adhesive or the like, to ensure that it does not become disassociated with the ring airfoil projectile during its flight. Further, the cover 74 portion of the strip 72 preferably engages the insert 57 as illustrated in FIG. 5.

The payload carried by the ring airfoil projectile 20 of the invention may comprise any of a variety of materials or agents. The agents may have a variety of chemical compositions and may be liquid, powder or of other forms.

In use, the ring airfoil projectile is launched from a launcher. Various types of launchers may be used to launch the ring airfoil projectile. In one embodiment, the ring airfoil projectile is mounted to a sabot (not shown). The sabot protects the ring airfoil projectile during launching.

Preferably, the sabot, and thus the associated ring airfoil projectile 20, are launched with a spin. Most preferably, the ring airfoil projectile 20 is launched with a rotational velocity, that velocity not greater than about 0.2 of the forward velocity. Spin may be imparted by launching the sabot and associated ring airfoil projectile 20 through a barrel of a launcher, the barrel having internal rifling. After launched by a launcher, the sabot is preferably stripped from the airfoil projectile, which travels forward while spinning.

It is desired that the ring airfoil projectile 20 have sufficient structure integrity that it is not damaged when launched or during flight, and yet breaks up upon impact to deliver the payload. Launching with a sabot has the advantage that the rifling in the barrel does not mar the ring airfoil projectile, thus degrading its aerodynamic characteristics. In addition, the sabot protects the ring airfoil projectile from damage from the explosive charge or other means used to launch the projectile.

In the preferred embodiment, as stated above, the ring airfoil projectile has static stability. Gyroscopic stability is imparted via the rotation of the ring airfoil projectile. As such, if the ring airfoil projectile is launched without disruption (i.e. wobble or shake such as due to movement of the launcher), the ring airfoil projectile will travel with minimum dispersion (i.e. will not deviate from its intended straight path). In particular, the spin and the coincidence of the center of pressure CP and center of gravity CG of the airfoil contribute to its stability.

When the ring airfoil projectile reaches its intended target, the ring airfoil projectile impacts the target. Advantageously, the ring airfoil projectile deforms upon impact. As indicated above, this increases the impact surface area and thus spreads the force over a wider area. At the same time, the payload 70 is released. The combination of spin and forward momentum causes the payload 70 to be dispersed and move towards the target. Among other things, the spinning of the ring airfoil projectile results in a centrifugal force which causes the released payload to be dispersed radially outward. At the same time, the forward velocity causes the dispersed material to continue traveling forward to the target.

The ring airfoil projectile of the invention has numerous advantages. As indicated above, the ring airfoil projectile has a center of pressure CP and center of gravity CG which are coincident or nearly coincident, contributing to the stability of the ring airfoil projectile in flight. This enables the ring airfoil projectile to travel with minimal dispersion, increasing the probability that the intended target will be hit.

In accordance with the invention, the multi-part construction of the ring airfoil projectile allows the ring airfoil projectile to be custom configured. As indicated, different aerodynamic shapes may be utilized. At the same time, however, changes may be made to sections of the ring airfoil projectile to then ensure that the center of pressure and center or gravity for those different designs to be coincident.

Another advantage is that the ring airfoil projectile may deliver a payload. The ring airfoil projectile is configured to deliver a significant amount of payload. The particular payload configuration of the ring airfoil projectile of the invention has several advantages. One advantage is that the ring airfoil projectile is configured to deliver payload while maintaining its stable flight characteristics and without compromising structural integrity. Some hollow ring airfoil projectiles have been developed in the past. These designs have the disadvantage that the body thickness of the projectile is substantially reduced, allowing the projectile to deform in flight and suffer from other problems associated with its lack of structural integrity. Further, these configures are more difficult to use, in the sense that the payload must be contained entirely within the enclosed airfoil, substantially complicating manufacturing.

The ring airfoil projectile 20 may be constructed in other fashions and still be configured both so that the center of gravity CG and the center of pressure CP are nearly coincident and, if desired, so that the ring airfoil projectile 20 can deliver a payload. For example, the ring airfoil projectile may have more than two sections, such as three or more. It is also possible for the ring airfoil projectile to comprise one body, but have that body comprise two or more different materials. For example, the body might be molded as a single element comprising two different materials.

The ring airfoil projectile 20 may also be configured to fragment or break apart when impacting a target, thereby releasing the payload.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A ring airfoil projectile comprising:

a ring airfoil comprising a nose section and a tail section, said nose and tail sections being selectively connectable to and disconnectable from one another, said nose section defining a nose of the ring airfoil and the tail section defining a tail of the ring airfoil, the ring airfoil having a passage therethrough, said passage having a central longitudinal axis, said nose section defining a first portion of said passage and said tail section defining a second portion of said passage, said first portion of said passage and second portion of said passage collectively forming said passage through said airfoil when said nose and tail sections are connected, said nose section having a rear face and said tail section having a front face, said rear face of said nose section and said front face of said tail section meeting in a plane extending substantially perpendicular to said central longitudinal axis through of said passage when said tail section is connected to said nose section, said nose section having an outer surface and a plurality of payload accepting cavities inset into said outer surface, said ring airfoil further comprising a payload associated with said payload accepting cavities, said nose section constructed of at least one material having a first density and said tail section constructed of at least one material having a second density, the first and second densities of said materials selected so a center of gravity of said ring airfoil projectile dependent upon a mass of said nose section, a mass of said tail section and a mas of said payload, is substantially coincident with a center of pressure thereof.

2. The ring airfoil projectile in accordance with claim 1 wherein one of said faces includes a key extending outwardly therefrom and the other face defines a slot for accepting said key.

3. The ring airfoil projectile in accordance with claim 1 wherein said material comprising said nose section comprises rubber and said material comprising said tail section comprises foam.

4. The ring airfoil projectile in accordance with claim 3 wherein one or more lightening holes are located in said tail section.

* * * * *